US007874843B2

(12) United States Patent
Hagan

(10) Patent No.: US 7,874,843 B2
(45) **Date of Patent: *Jan. 25, 2011**

(54) DRAWING TABLET FOR UNDERWATER OR EXTREME ENVIRONMENT

(76) Inventor: Mark L. Hagan, 990 Bradley Hill Rd., Nyack, NY (US) 10960

( * ) Notice: Subject to any disclaimer, the term of this patent is extended or adjusted under 35 U.S.C. 154(b) by 466 days.

This patent is subject to a terminal disclaimer.

(21) Appl. No.: 11/899,258

(22) Filed: Sep. 4, 2007

(65) Prior Publication Data

US 2008/0057485 A1 Mar. 6, 2008

Related U.S. Application Data

(63) Continuation-in-part of application No. 10/842,385, filed on May 10, 2004, now Pat. No. 7,264,477.

(60) Provisional application No. 60/471,489, filed on May 15, 2003.

(51) Int. Cl.
*B43L 1/00* (2006.01)

(52) U.S. Cl. ..... 434/408

(58) Field of Classification Search ..... 434/408
See application file for complete search history.

(56) References Cited

U.S. PATENT DOCUMENTS 2,883,770 A * 4/1959 Lieb ..... 434/433
3,781,536 A * 12/1973 Naeseth et al. ..... 362/34
4,083,136 A * 4/1978 Zelenko ..... 40/518
4,960,399 A 10/1990 Lyon
4,995,015 A * 2/1991 Chiang ..... 368/11
5,083,242 A * 1/1992 Piotrowski ..... 362/34
5,361,169 A * 11/1994 Deal ..... 359/838
5,447,215 A 9/1995 Volkmar et al.
5,956,291 A * 9/1999 Nehemiah et al. ..... 367/131
6,098,793 A 8/2000 Jaksha
6,116,484 A * 9/2000 Allen ..... 224/197
6,161,740 A * 12/2000 Allen ..... 224/197
7,264,477 B1 * 9/2007 Hagan ..... 434/408
2004/0191753 A1 * 9/2004 Meyerrose ..... 434/410
2004/0197758 A1 * 10/2004 Langford ..... 434/317
2008/0060855 A1 3/2008 Hagan

OTHER PUBLICATIONS

Notice of Allowance dated Jan. 19, 2010 in connection with related U.S. Appl. No. 11/897,968.

* cited by examiner

*Primary Examiner*—Gene Kim
*Assistant Examiner*—Dolores Collins
(74) *Attorney, Agent, or Firm*—Cooper & Dunham LLP

(57) ABSTRACT

A writing or drawing tablet that is suitable for use in an underwater or any extreme environment is provided. A length of waterproof (plastic) vellum is stretched between two rollers over a flat surface thereby enabling the user to easily draw or write on the vellum to save the drawing and writing.

17 Claims, 12 Drawing Sheets

Submersible Drawing Tablet

Submersible Drawing Tablet

Submersible Drawing Tablet

Submersible Drawing Tablet

Submersible Drawing Tablet

Submersible Drawing Tablet

Submersible Writing Tablet
Second Embodiment

Submersible Writing Tablet
Second Embodiment

DRAWING TABLET FOR UNDERWATER OR EXTREME ENVIRONMENT

CROSS REFERENCE TO RELATED APPLICATIONS

This disclosure is a continuation-in-part of U.S. application Ser. No. 10/842,385, filed May 10, 2004, now U.S. Pat. No. 7,264,477, which claims the benefit of U.S. Provisional Application No. 60/471,489, filed May 15, 2003, the entire contents of each of which are herein incorporated by reference.

TECHNICAL FIELD

The present disclosure relates to relates to writing/drawing tablets suitable for an underwater or any extreme environment.

BACKGROUND ART

There are many reasons a scuba diver may need to write or draw underwater. For example, a diver may need or wish to communicate with other divers. In addition, the diver may desire to record notes, to aid in gathering reference material, architectural drafting for marine construction, artistic rendering, etc.

Conventionally, most underwater communications are accomplished with hand signals, dive slates and/or electronic instruments. Hand signals can be confusing and are limited in what they can communicate.

Dive slates are limited in the amount that they can record by the size of the slate. When the slate is full, new writing can only be added by erasing all previous work. In urgent situations this erasing time can be inconvenient.

Use of electronic equipment is expensive and often vulnerable in the underwater environment.

Use of multiple pages of waterproof material on a clipboard underwater is awkward because in the marine environment the pages can stick together and are difficult to manipulate especially if the diver is wearing gloves. Multiple page slates also cannot be reused until all previous work has been erased.

Use of a compact note scroll configured with a base on which a pair of rotatably mounted shafts carry an elongated strip of paper, an intermediate portion of which is accessible through a window aperture in a case which covers the base, is proposed in U.S. Pat. No. 4,083,136 (Zelenko). Although Zelenko proposes that the paper can be replaced by coated flexible plastic, so that writing on the strip can be easily erased by rubbing with a cloth or the like, writing on the plastic would readily fade, dissolve or otherwise be removed from the plastic, when under water. The compact note scroll proposed by Zelenko is simply not suitable for the underwater environment.

BRIEF SUMMARY

According to an aspect of the present disclosure, a writing or drawing tablet is provided comprising first and second rollers, a cover plate including first and second vellum slots, a plastic vellum sheet rolled around the first and second rollers and placed over the cover plate and passing through the first and second vellum slots, and tension adjustment mechanism configured to maintain a consistent tension in the vellum sheet when the vellum is loaded on the roller and through the vellum slots. The writing or drawing tablet is configured for an underwater or any extreme environment.

In another aspect, the writing or drawing tablet preferably includes a mechanism (for example, one or more slots in the rollers) which grasp the vellum when the vellum is loaded on the roller and maintain a consistent tension on the vellum between the rollers, to maintain a flat writing surface while preventing the vellum from becoming disengaged from the rollers during use.

In another aspect, the writing or drawing tablet can be made of one or more materials that are resistant to corrosion and/or impervious to salt water and intensive exposure to sunlight.

In another aspect, the writing or drawing tablet does not retain air in the underwater environment and does not retain water when removed from the underwater environment.

In another aspect, the writing or drawing tablet is configured to have a negative buoyancy at depth of about 50 feet.

In another aspect, the cover plate is preferably formed of a phosphorescent material In another aspect, the writing or drawing tablet can include a woodless graphite drawing pencil attached thereto (for example, via a flexible holding tube).

In another aspect, a grid pattern (or other pattern or information) is visually presented via the plastic vellum sheet, such as by pre-printing such pattern or information on the vellum.

BRIEF DESCRIPTION OF THE DRAWINGS

The features of the subject matter of this disclosure can be more readily understood from the following detailed description with reference to the accompanying drawings wherein.

DETAILED DESCRIPTION OF EXEMPLARY EMBODIMENTS

Figure 1:
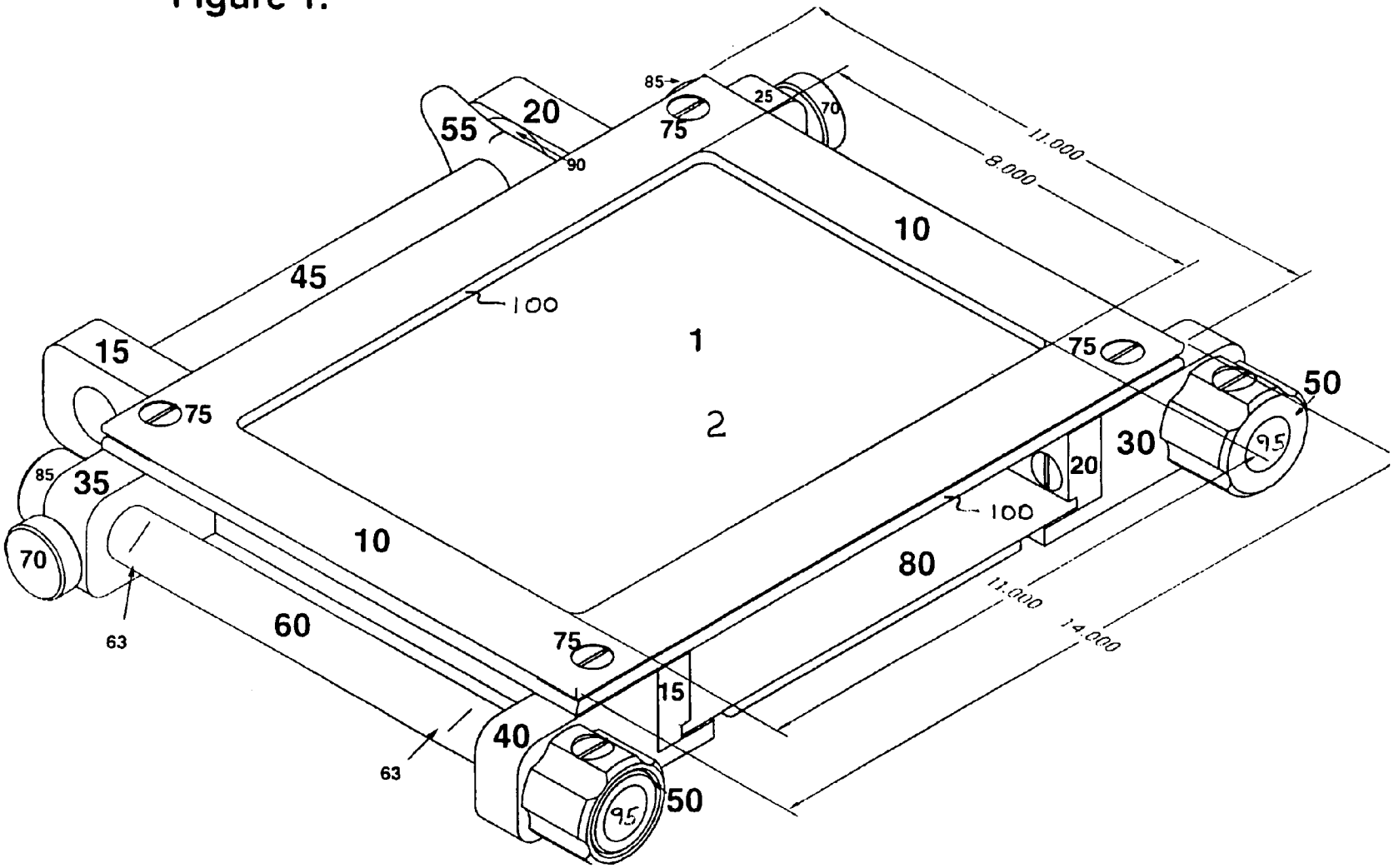
FIG. 1 is a perspective view of a drawing tablet, according to an exemplary embodiment of the present disclosure.

In describing examples and preferred embodiments illustrated in the drawings, specific terminology is employed for the sake of clarity in this patent specification. However, this disclosure is not intended to be limited to the specific terminology so selected and it is to be understood that each specific element includes all technical equivalents that operate in a similar manner. In addition, a detailed description of known functions and configurations will be omitted when it may obscure the subject matter of the present disclosure. In the description below, like reference numerals are used to describe the same, similar or corresponding parts in the several views of the drawing.

First Embodiment

A drawing tablet according to a first embodiment of the present disclosure is a hand held device as shown in FIG. 1. The diver can draw or write continuously, accessing various writing instruments such as pencils (not shown) stored in a drawer 80 and advancing a plastic writing material easily with one hand while the other stabilizes the tablet through the use of a handle 45 on one side.

The tablet is designed, through the use of buoyant materials such as polystyrene, to have a slightly negative buoyancy at a depth of about fifty feet so that it can be very easy to manipulate underwater and will not sink or ascend rapidly if let go.

Underneath the face plate 1 used as a drawing table is a retractable drawer 80 to hold drawing instruments (not shown) through the use of a hook and loop material on its surface and that of the drawing instrument holders. The drawer 80 can be locked in an extended position or in a retracted position. The drawer 80 does not have sides so that it will not retain air or water during entrances or exits of the water's surface.

On each end of the face plate 1 used as a drawing table are rollers 60 and 65 for holding lengths of plastic vellum 2 (not shown for clarity) used as the drawing medium. Through the use of grips 50 on the ends of the rollers 60 and 65 the plastic vellum 2 can be wound from one roller to the other as it is used.

The submersible drawing tablet parts are constructed of various plastic resin materials that are impervious to salt water such as polycarbonate, acrylic Plexiglas and polystyrene. The acrylic Plexiglas is produced in bright fluorescent colors so that the pallet can be located easily if it is set aside underwater where visibility can be poor.

The submersible drawing tablet is designed so that it can easily be disassembled for travel.

The first embodiment of the submersible writing and drawing tablet will now be described by referring to FIGS. 1-6. The overall submersible writing and drawing tablet is shown in FIG. 1.

All writing and illustration is done on rolls of plastic vellum with a writing instrument such as a graphite pencil. The vellum 2 is wound onto the lower vellum roller 60. The lower roller 60 is made of buoyant polystyrene and has a small diagonal vellum slot 63 on each side of the roller to grasp the vellum as it is being loaded onto the roller. The lower roller 60 is supported by the left and right lower roller supports 35 and 40. The lower roller 60 extends past the left and right roller supports 35 and 40 and is held in place by the left roller end knob 85 on the left and the rotation knob 50 and the right roller end knob 95 on the right. The vellum 2 is advanced or rewound by turning the rotation knobs 50. The plastic vellum 2 (not shown for clarity) extends from the lower roller 60, over the face plate 1 and is attached to the upper vellum roller 65 (not visible in FIG. 1) by means of two other diagonal vellum slots 63 shown in FIGS. 1 and 5. The face plate 1 is constructed of phosphorescent polypropylene or Plexiglas to accommodate working in low light conditions. The face plate 1 can also include a grid (not shown) as a drawing aid. As an alternative, the vellum can include pre-printed grid lines and/or points The upper vellum roller 65 is held in place by the right and left roller supports 25 and 30, the right roller end knob 85 on the left and the rotation knob 50 and the right roller end knob 95 on the right.

The upper roller supports 25 and 30 are connected to the upper support rail 20 by two ⅜" flat head nylon screws 75. The lower roller supports 35 and 40 are connected to the lower support rail 15 by two ⅜" flat head nylon screws 75 shown in FIGS. 1 and 6. The vellum 2 is held tightly against the face plate 1 by use of the roller tension adjustment knobs 70 that apply pressure when turned clockwise to the upper and lower vellum rollers 60 and 65. The vellum 2 is also held in place on the face plate 1 by use of vellum guides located on the face plate 1 and by use of the drawing frame 10. The drawing frame 10 and the face plate 1 are attached to the upper and lower roller supports through separators 100 by four nylon screws 75 located in each corner. Vellum 2 travels between drawing frame 10 and face plate 1.

Figure 3:
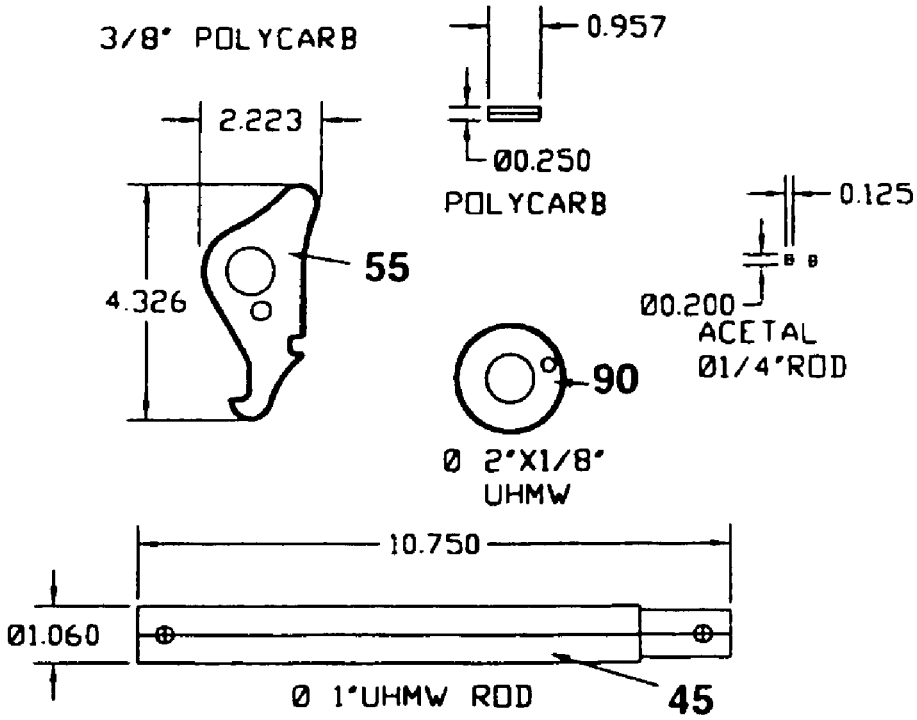
FIG. 3 is a detailed diagram showing a drawer latch assembly and handle of the embodiment shown in FIG. 1.
Figure 4:
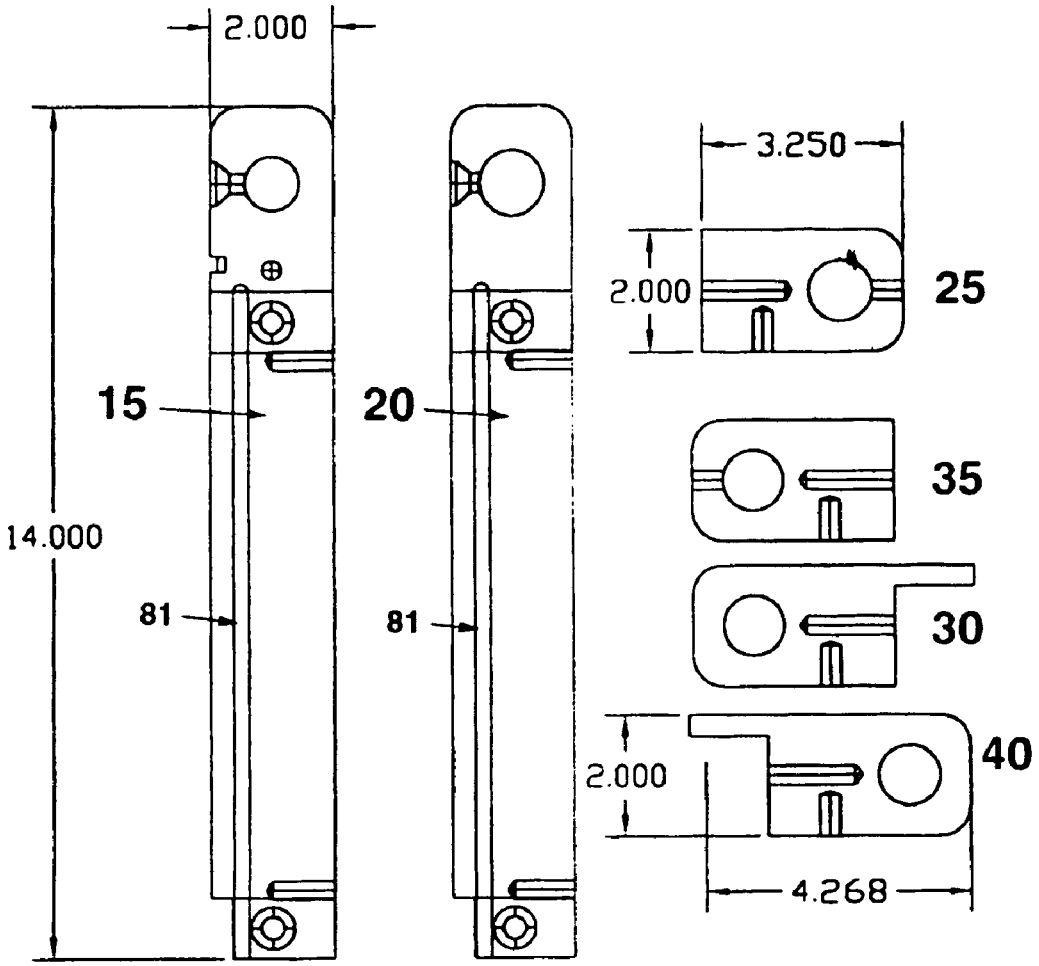
FIG. 4 is a detailed diagram showing support rails and roller supports of the embodiment shown in FIG. 1.
Figure 5:
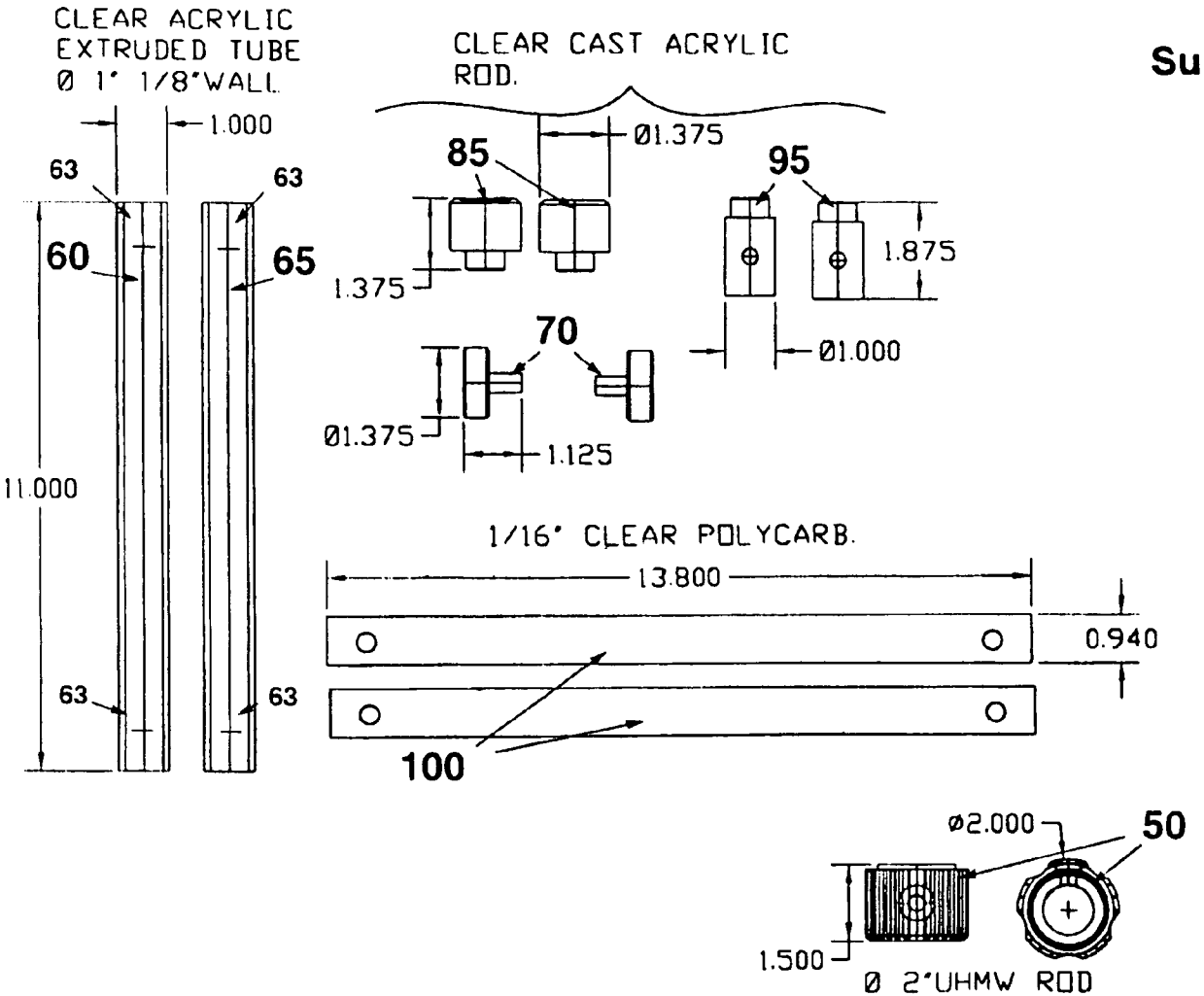
FIG. 5 is a detailed diagram showing rollers and knobs of the embodiment shown in FIG. 1.

The upper and lower support rails 20 and 15 extend beyond the left side of the face plate 1 and drawing frame 10 to provide support for the handle 45 and the drawer latch assembly 55 and 90, details shown in FIG. 3. Fitted into the drawer grooves 81 shown in FIG. 4 on the inner sides of the upper and lower support rails 20 and 15 is the drawer 80.

Figure 2:
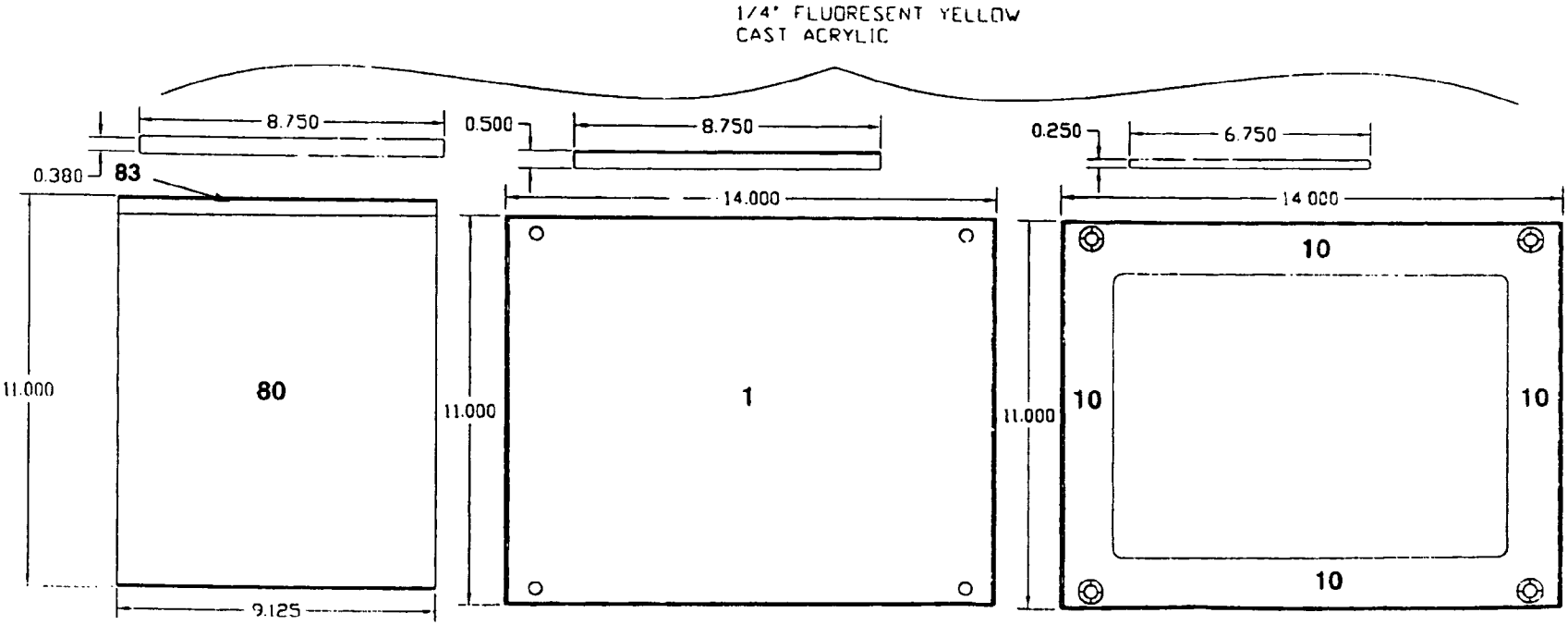
FIG. 2 is a detailed diagram showing a drawing frame, a face plate, and a drawer in the drawing tablet of the embodiment shown in FIG. 1.

As shown in FIG. 2, along the back edge of the drawer 80 is the ¼" high drawer clasp 83 that is grasped by the drawer release trigger 55 (shown in FIG. 1). The drawer release trigger 55 applies pressure to the drawer clasp 83 by use of a common rubber band (not shown) wound through a notch in the trigger 55 and attached to a nylon screw 75 in the upper support rail 20. This is used to keep the drawer 80 retracted when not in use. The surface of the drawer 80 is covered with hook and loop material so that various writing and drawing instruments (not shown) that utilize the same material can be attached to it.

All the components of the submersible drawing and writing tablet are connected to each other through the use of the nylon screws 75. The width of the slot in these screws is designed to be used with a large coin such as a fifty-cent piece or a Peso rather than a screwdriver. In this way tools are not needed to assemble or disassemble the submersible tablet and the screws will resist stripping due to the lack of edges of the coins.

Second Embodiment

Figure 6:
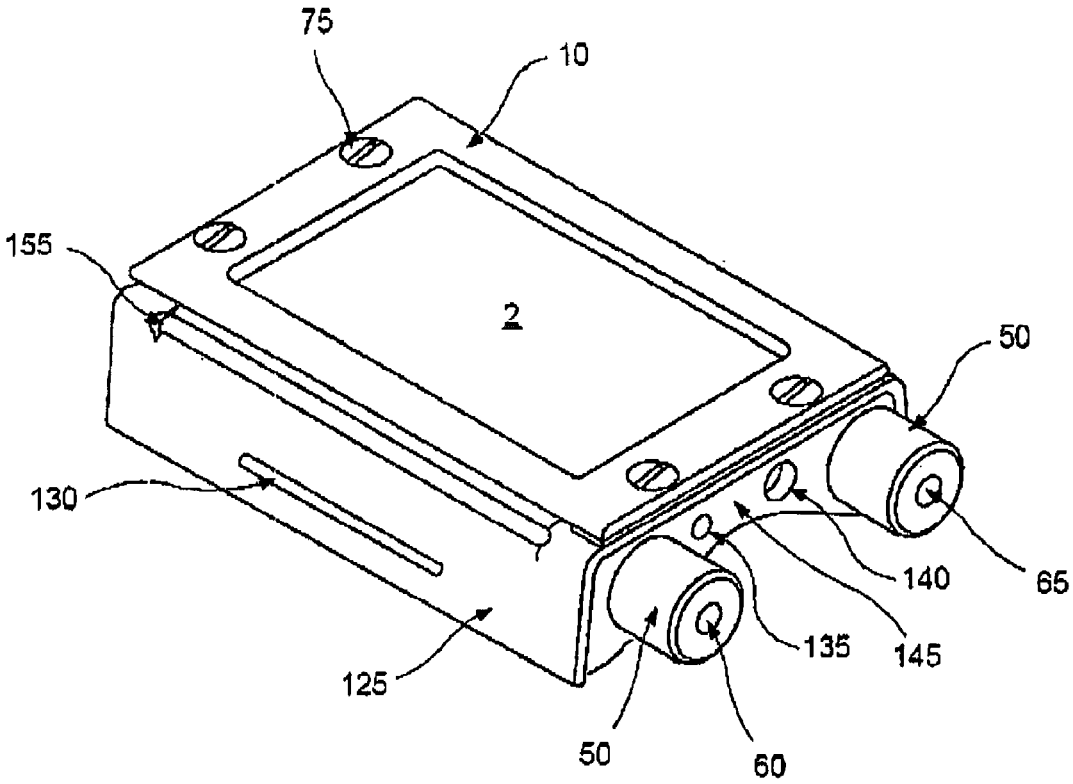
FIG. 6 is a perspective view of a drawing tablet, according to a second embodiment of the present disclosure.

A second embodiment of the present disclosure is shown in FIG. 6 and is a smaller version of the submersible writing tablet designed to be worn on the arm of the diver and used primarily for communication between scuba divers and for note taking. This second version also uses plastic vellum 2 stretched between two rollers 60 and 65 running parallel to the diver's arm. Writing on the vellum 2 is accomplished with a graphite pencil 170 held in a holder 140 under the drawing surface between the rollers. This smaller version does not have the utility drawer 80 of the larger version and is not designed to be collapsible. This wrist model also is constructed primarily of polycarbonate, acrylic and polypropylene. The device is worn on the diver's arm through the use of a length of hook and loop material 160 that is attached to the underside of the tablet and can be adjusted to accommodate the circumference of the diver's arm by the use of the hook and loop material. The device is small enough so that it can also fit in a pocket or be attached by a lanyard to the Diver.

The Second Embodiment of the submersible writing and drawing tablet will now be described by referring to FIGS. 6-11. The overall submersible writing and drawing tablet is shown in FIG. 6.

All writing and illustration is accomplished on rolls of plastic vellum 2. The vellum 2 is wound onto the lower vellum roller 60. As in the first embodiment, the roller also has a vellum slot to grasp the vellum as it is being loaded onto the roller 60.

Figure 7:
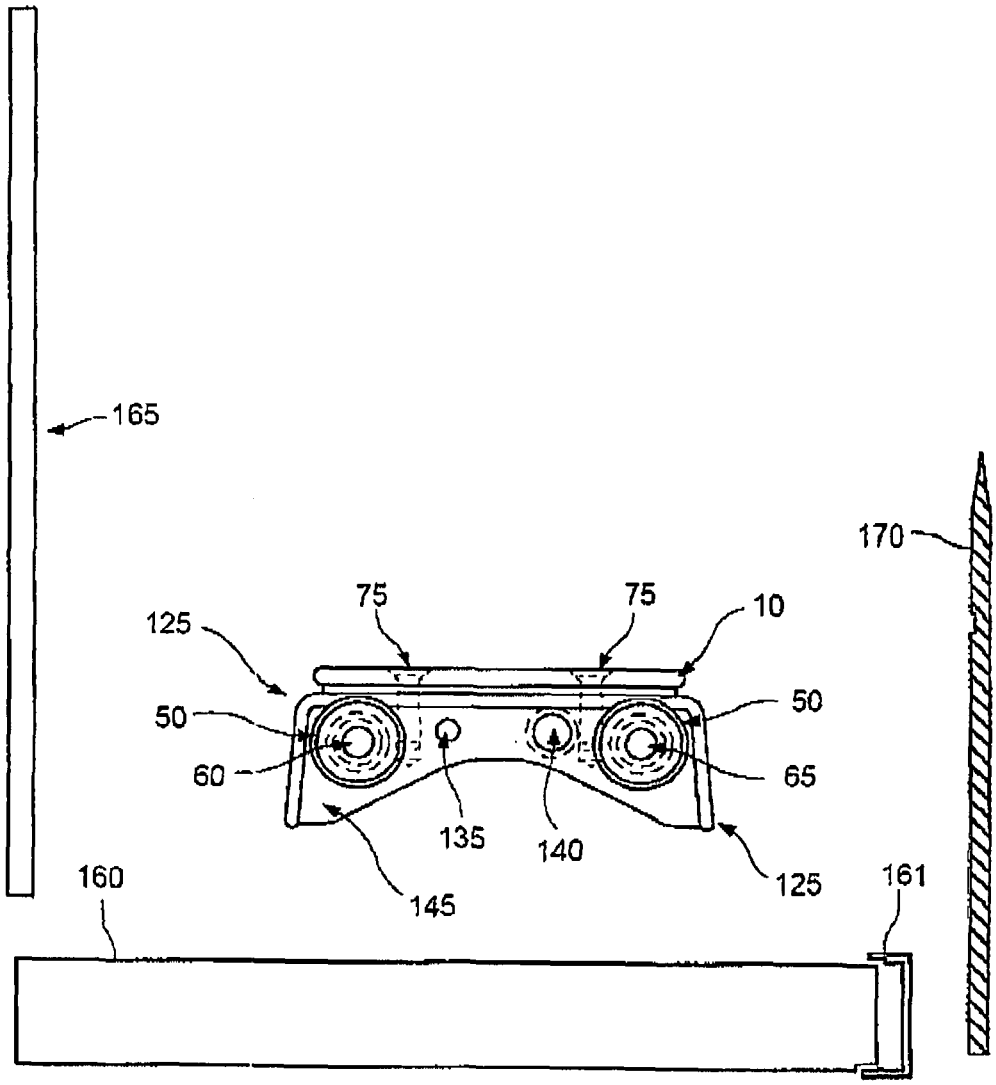
FIG. 7 is a side view of the drawing tablet according to the embodiment of FIG. 6.
Figure 8:
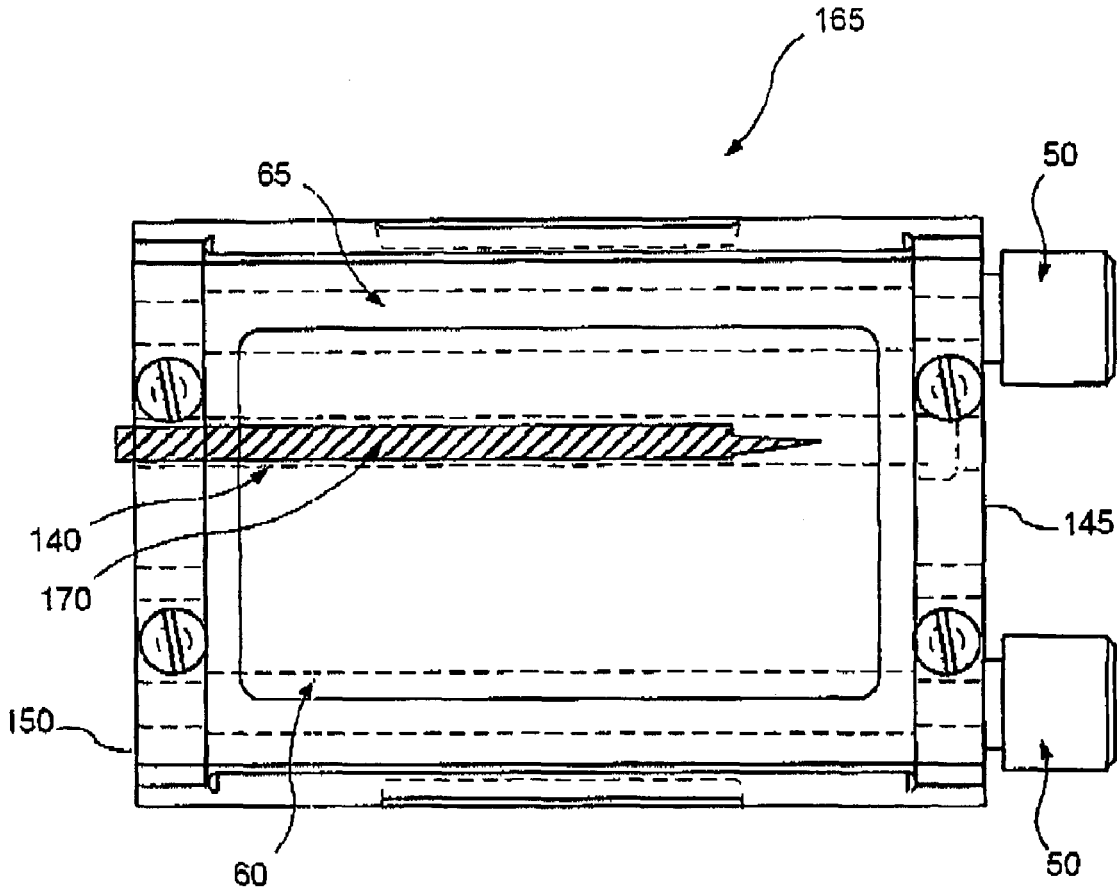
FIG. 8 is a top view of the second embodiment shown in FIG. 6.

The lower vellum roller 60 and the upper vellum roller 65 are held in place by the right and left cover plate supports 145 and 150 shown in FIGS. 6 and 8. Both vellum rollers 60 and 65 fit into openings in the left cover plate support 150, shown in FIG. 8, and extend through and beyond openings in the right cover plate support 145. One of roller knobs 50 is attached by pressure fitting to the right ends of each of the vellum rollers 60 and 65, shown in FIGS. 6 and 7.

The second embodiment of the submersible writing tablet is not designed to be dismantled since its small size makes this unnecessary. The vellum is advanced or rewound by turning the rotation knobs 50. The plastic vellum 2 extends from the lower roller 60, through the lower vellum slot 155 over the cover plate 125 to the upper vellum roller 65. The cover plate 125 is constructed of phosphorescent polypropylene or plexiglass to aid with visibility under low light conditions. The vellum 2 then passes through the upper vellum slot 155 to the upper vellum roller 65 and, as in the first embodiment, is attached by means of a slot in the vellum rollers.

Figure 12:
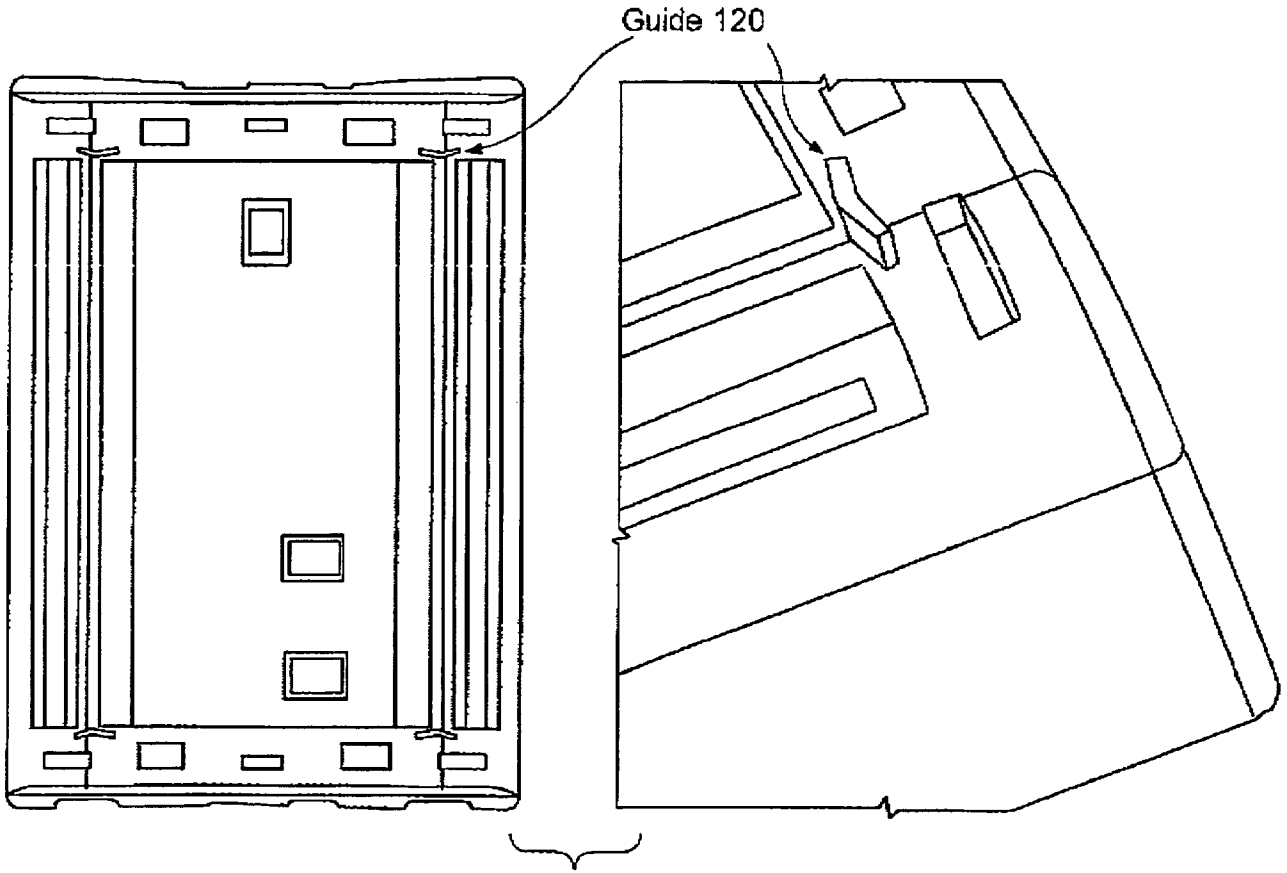
FIGS. 12A and 12B are views of a drawing tablet, according to a third embodiment in which vellum guides are located on the top of a cover plate.

The vellum 2 is held in place by the drawing frame 10 that is attached to the cover plate 125 by means of four nylon screws 75 that pass through the cover plate 125 and thread into the left and right cover plate supports 145 and 150. Vellum 2 travels between cover plate 125 and drawing frame 10. In addition, the alignment of the vellum can be kept consistent through the use of vellum alignment guides 120 located on the top of the base (FIGS. 12A and 12B). Each of the vellum rollers can have a tension adjustment mechanism configured to apply pressure on the roller to maintain the tension of the plastic vellum sheet rolled around the rollers. Each of these mechanism can contribute to alignment of the vellum in an aligned position (that is, as the vellum is wound around the roller each layer aligns width-wise with the layer below it) so that the vellum does not become unaligned as the vellum is being wound around the roller.

Pencil holder 140 is positioned between the upper and lower vellum rollers 60 and 65 and attached to openings in the left and right cover plate supports 145 and 150, shown in FIGS. 7 and 8. Next to the pencil holder 140 is a small opening 135 into which one end of rubberized pencil holding tube 165 is held therein. The other end of pencil holding tube 165 is stretched over one end of the graphite drawing pencil 170.

Figure 9:
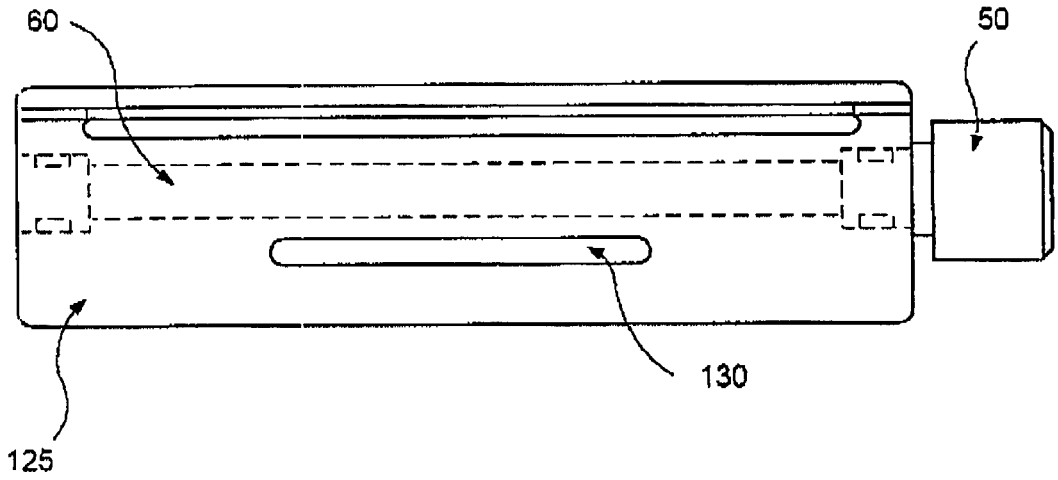
FIG. 9 is a side view of the second embodiment shown in FIG. 6.
Figure 10:
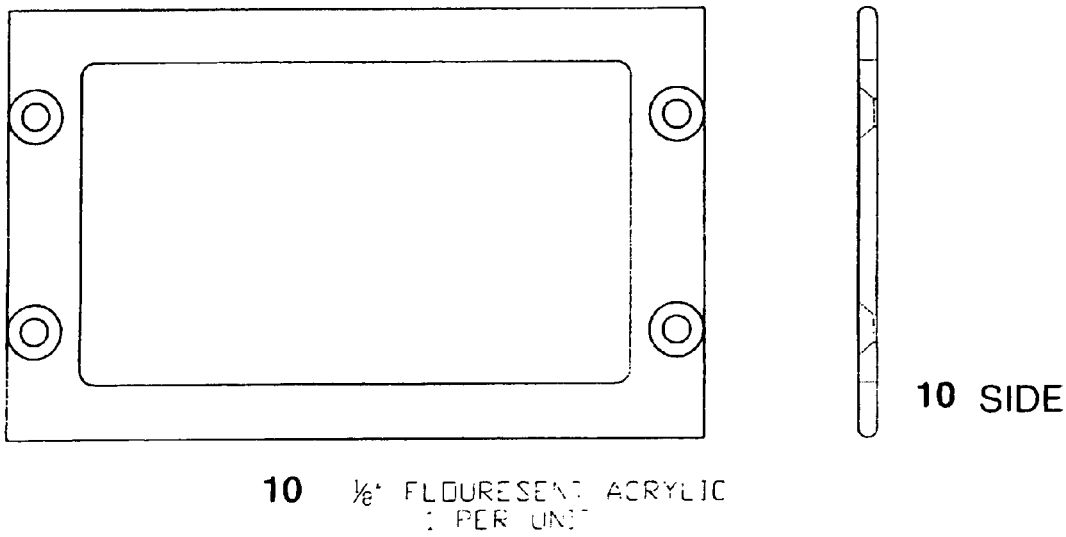
FIG. 10 is a detailed diagram showing a drawing frame of the second embodiment shown in FIG. 6.
Figure 11:
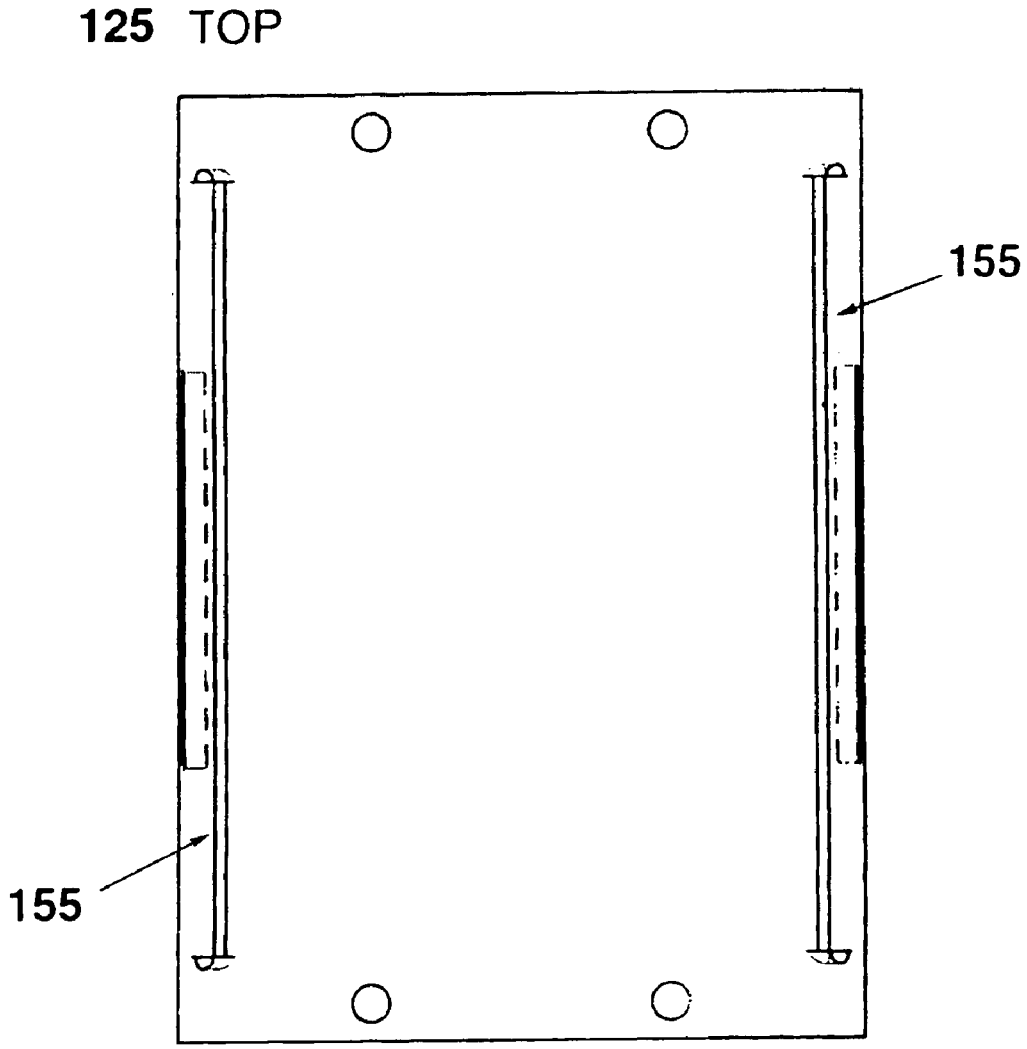
FIG. 11 is a top view of a cover plate of the second embodiment shown in FIG. 6.

The second embodiment of the submersible writing tablet is attachable to the diver's arm by means of a length of hook and loop material forming an arm belt 160 that passes through respective arm belt slots 130 on each side of the cover plate 125 as shown in FIGS. 6, 7, and 9. One end of the arm belt 160 passes through a plastic loop 161 sewn into the opposite end of the belt 160. The belt 160 is then folded back on itself and attached by means of the hook and loop material. The unit also has an attachment point for the use of a lanyard 13.

The subject matter of this disclosure is particularly suited for use in an underwater environment.

Use of plastic vellum sheet is preferred because it is semi transparent and can be backlit by, for example, a phosphorescent material of the back plate, on night dives or dives in low light. In general, the distinct qualities of the vellum material renders it particularly suitable for the underwater environment and selection of the material of other parts and a writing implement are preferably complementary with it in the marine environment.

However, one of the properties of plastic vellum sheets is that they have a natural tendency to unravel. Accordingly, the writing tablet preferably includes means which help to maintain tension of the plastic vellum sheet rolled around plastic rollers in the writing tablet, even when the rollers are not being rotated. A consistent tension is applied to the vellum sheet between the rollers so that the vellum sheet will remain flat and will not rewind, jam or release from the roller slots, during use underwater or in any extreme environment. When underwater, in high wind or low gravity, air or water can get behind the vellum causing it to "balloon" up from the back plate making writing difficult and causing the vellum to unroll or unwind, if a tensioning mechanism is not included.

A tension adjustment mechanism (for example, knob 50 in FIG. 1, a screw, etc.) can be provided to maintain tension of the plastic vellum sheet rolled around the rollers. In another example, vellum slots (for example, 155 in FIGS. 6 and 11) are provided in the cover plate, and maintain a consistent tension in the vellum sheet when the plastic vellum sheet is rolled around the rollers, placed over the cover plate and passes through the vellum slots. In addition, each of the rollers includes one or more slots, with the one or more slots grasping the vellum when the vellum is loaded on the roller, and thus by maintaining a consistent tension on the vellum between the rollers and the vellum sheet will not release from the roller when the roller is not being turned. The tensioning mechanism also keeps the writing surface of the vellum flat against the face plate (FIG. 1, #1) in any extreme environment such as underwater, high wind or low gravity situations.

In addition, when a device is used in the marine environment it should preferably be able to shed water and air quickly when it enters or leaves the water, and should preferably also be designed so that there are no areas where miscellaneous corroding agents such as sand and salt can be retained. The device is preferably robust enough to hold up to the rigors of the demanding scuba environment.

Accordingly, one or more of the following optional features directed to use in an underwater environment can also be included: (a) a woodless graphite drawing pencil is attached to the writing tablet via a flexible holding tube; (b) the cover plate is formed of a phosphorescent material; (c) the underwater writing tablet is formed to have a negative buoyancy at depth of about 50 feet; (d) the underwater writing tablet is made of one or more materials that are resistant to corrosion and/or impervious to salt water and intensive exposure to sunlight; (e) the underwater writing tablet does not retain air in the underwater environment and does not retain water when removed from the underwater environment; and (f) a grid pattern (or other pattern or information) is visually presented via the plastic vellum sheet, such as by pre-printing such pattern or information on the vellum; (g) a mechanism (for example, one or more slots in the rollers which grasp the vellum when the vellum is loaded on the roller) to maintain a consistent tension on the vellum between the rollers and maintain a flat writing surface while preventing the vellum from becoming disengaged from the rollers during use.

The above-described examples and exemplary embodiments are illustrative, and many variations can be introduced on these examples and embodiments without departing from the spirit of the disclosure or from the scope of the appended claims. For example, elements and/or features of different examples and illustrative embodiments may be combined with each other and/or substituted for each other within the scope of this disclosure and appended claims.

Some additional features may be included in a drawing and writing tablet, including the following.

For example, writing and drawing on the drawing and writing tablet is preferably of a permanent nature.

In addition, the drawing and writing tablet preferably is configured to provide an unlimited amount (that is, a large amount that exceeds an amount that can be consumed in one or a few dives) of workable media underwater.

Also, the drawing and writing tablet is preferably configured to provide workable media quickly and easily in an underwater environment, for example, through use of scrolling mechanism rather than pages which require flipping.

Further, the drawing and writing tablet preferably provides a writing and drawing surface that is phosphorescent to accommodate working in low light conditions.

In addition, the drawing and writing tablet is preferably configured to have a buoyancy underwater that renders it nearly weightless and to shed air and water so as not to encumber the diver as he or she enters or leaves the water.

Also, the drawing and writing tablet can be configured to be easily disassembled for travel.

What is claimed is:

1. A writing or drawing tablet configured for use in an underwater or extreme environment, comprising:

first and second rollers;

a cover plate including first and second vellum slots; and a plastic vellum sheet rolled around said first and second rollers and placed over said cover plate and passing through said first and second vellum slots; and a tension adjustment mechanism configured to apply pressure on one of said first and second rollers to maintain tension of the plastic vellum sheet rolled around said rollers, wherein said tension adjustment mechanism and said first and second vellum slots maintain a consistent tension in the vellum sheet when the vellum is loaded on the roller and through the vellum slots.

2. The writing or drawing tablet according to claim 1, further comprising a vellum alignment mechanism to maintain the vellum in an aligned position as the vellum is being wound around one of the rollers.

3. The writing or drawing tablet according to claim 1, further comprising a retractable lanyard.

4. The writing or drawing tablet according to claim 1, further comprising a drawing frame attached to said cover plate and wherein said plastic vellum sheet is placed between said cover plate and said drawing frame.

5. The writing or drawing tablet according to claim 4, wherein at least one of said cover plate and said drawing frame is formed of a phosphorescent material.

6. The writing or drawing tablet according to claim 1, further comprising a retractable drawer placed under said cover plate.

7. The writing or drawing tablet according to claim 6, further comprising a drawer release trigger assembly for releasing said retractable drawer.

8. The writing or drawing tablet according to claim 1, further comprising a handle placed between said first and second rollers.

9. The writing or drawing tablet according to claim 1, wherein said vellum includes a plurality of grid lines and/or points.

10. The writing or drawing tablet according to claim 1, wherein said cover plate includes a grid pattern.

11. An underwater writing or drawing tablet comprising:

first and second rollers;

a cover plate including first and second vellum slots; and a plastic vellum sheet rolled around said first and second rollers and placed over said cover plate and passing through said first and second vellum slots; and a vellum alignment mechanism configured to maintain the vellum in an aligned position as the vellum is being wound around one of the rollers a tension adjustment mechanism configured to apply pressure on one of said first and second rollers to maintain tension of the plastic vellum sheet rolled around said rollers, wherein said tension adjustment mechanism, said vellum alignment mechanism and said first and second vellum slots maintain a consistent tension in the vellum sheet when the vellum is loaded on the roller and through the vellum slots.

12. The underwater writing or drawing tablet according to claim 11, further comprising a retractable lanyard.

13. The underwater writing or drawing tablet according to claim 11, further comprising a handle placed between said first and second rollers.

14. The underwater writing or drawing tablet according to claim 11, further comprising a drawing frame attached to said cover plate and wherein said plastic vellum sheet is placed between said cover plate and said drawing frame.

15. The underwater writing or drawing tablet according to claim 14, wherein at least one of said cover plate and said drawing frame is formed of a phosphorescent material.

16. The underwater writing or drawing tablet according to claim 11, further comprising a retractable drawer placed under said cover plate.

17. The underwater writing or drawing tablet according to claim 16, further comprising a drawer release trigger assembly for releasing said retractable drawer.

* * * * *